US005474151A

United States Patent [19]

Yonahara

[11] Patent Number: 5,474,151

[45] Date of Patent: Dec. 12, 1995

[54] FOLDING SCAFFOLD FOR A CONSTRUCTION WORK

[75] Inventor: Yoshihiro Yonahara, Ohmiya, Japan

[73] Assignee: Japan Steels International Inc., Tokyo, Japan

[21] Appl. No.: 197,264

[22] Filed: Feb. 16, 1994

[30] Foreign Application Priority Data

Nov. 16, 1993 [JP] Japan ..... 5-309911

[51] Int. Cl.[6] ..... E04G 1/00

[52] U.S. Cl. ..... 182/152; 182/119

[58] Field of Search ..... 182/152, 119, 182/222, 178, 179, 118

[56] References Cited

U.S. PATENT DOCUMENTS

| | | | |
|---|---|---|---|
| 2,446,005 | 7/1948 | Hartmann . | |
| 2,941,616 | 6/1960 | Grover | 182/152 X |
| 3,498,412 | 3/1970 | Best | 182/152 |
| 5,086,875 | 2/1992 | Shreve | 182/152 |
| 5,099,953 | 3/1992 | Stegath | 182/152 |

FOREIGN PATENT DOCUMENTS

| | | | |
|---|---|---|---|
| 1415514 | 9/1965 | France . | |
| 8006557 | 7/1981 | Netherlands | 182/152 |
| 1110670 | 4/1968 | United Kingdom . | |
| 1311569 | 3/1973 | United Kingdom . | |

*Primary Examiner*—Alvin C. Chin-Shue
*Attorney, Agent, or Firm*—Wenderoth, Lind & Ponack

[57] ABSTRACT

In a scaffold for construction work, four supports are provided at the respective corners of a rectangle. The front and rear supports on each side are connected to each other by connecting frames which can be folded without changing the height of the scaffold. After the connecting frames are folded, a scaffolding floor member provided on the top surface enclosed by the four supports can be rotated about its one end so as to pivot to a lowered vertical position.

4 Claims, 6 Drawing Sheets

FOLDING SCAFFOLD FOR A CONSTRUCTION WORK

BACKGROUND OF THE INVENTION

1. Field of the Invention

The present invention relates to a folding scaffold for construction work which allows operators to climb to high places when they work on a ceiling or a high portion of a wall at a construction site, and which can be moved easily.

2. Prior Art

Conventionally, when construction work has needed to be performed on a ceiling or a high portion of a wall, a frame is built parallel with the wall using pipes and clamps, and scaffolding plates are held by the frame so that operators can stand thereon. A folding scaffold is known which can be easily carried and assembled. In such a folding scaffold, as disclosed in Japanese Patent Application Unexamined Publication No. Hei. 2-85467 and Japanese Utility Model Application Unexamined Publication No. Sho. 62-110439, wheels are attached to the lower ends of supports to make the scaffold mobile. Furthermore, the scaffold is cut along its center line into halves which are connected by hinges. To fold the scaffold, the center-side ends of the scaffolding plates of the halves are lifted and the halves are vertically erected at the center of the scaffold. The scaffold is stored in this state.

Since the above folding scaffold is folded by erecting the halves vertically, it has a large height in its storage (folded) state. As a result, there will occur inconveniences in transport; for example, it may not be possible to load it into a freight elevator. Furthermore, since the scaffold has a large height in the folded state, it is difficult for a single operator to fold the scaffold vertically and unfold it horizontally.

SUMMARY OF THE INVENTION

In view of the above, one object of the present invention is to provide a scaffold which is relatively low in height while it is in the folded state, to thereby facilitate its transport. Another object of the invention is to provide a scaffold which can be more easily unfolded from the storage state to the usage state.

According to the invention, a folding scaffold for a construction work comprises supports having wheels attached to their respective lower ends and provided at at least four corners of a rectangle; horizontal bars connecting the two front supports and other horizontal bars connecting the two rear supports; a connecting frame provided between the front and rear supports on one side So as to be located approximately in the upper space of the scaffold and another connecting frame provided between the front and rear supports on the other side so as to be located approximately in a lower half of the scaffold, each connecting frame having front and rear end portions that are rotatably connected to the respective supports through vertical shafts, and each connecting frame cut along its center line into adjacent halves that are rotatably connected to each other through vertical shafts. A scaffolding floor member is also provided in a top portion enclosed by the four supports and having a size large enough to cover the top portion, the scaffolding floor member having a front or rear end portion that is rotatably connected to top portions of the supports through horizontal shafts, as well as engaging segments provided in the other end portion of the scaffolding floor member and serving to detachably engage with the top portions of the supports on this side.

Instead of providing the scaffolding floor member that covers the top surface enclosed by the four supports located at the respective corners, a scaffolding plate may be put between a horizontal bar provided at the upper end between the two front supports and a horizontal bar provided at the upper end between the two rear supports, and to allow operators to stand thereon.

Each supporting pipe is constituted as a double pipe capable of expansion and contraction in the longitudinal direction, and a fixing means is provided to fix the supports to a predetermined length. Furthermore, handrails are detachably provided on the top surface of the scaffolding floor member.

According to another constitution, a folding scaffold for construction work comprises two central supporting members spaced apart from each other and having wheels attached to their lower ends; connecting frames provided on both sides of each central supporting member and shaft-connected to each other so as to be foldable; supports provided outside of and connected to the connecting frames and having respective wheels attached to their lower ends; scaffolding floor members provided on both sides of the two central supporting members, each scaffolding floor member having one end portion that is connected to the corresponding central supporting member through horizontal shafts; and engaging segments provided in the other end portion of each scaffolding floor member and serving to engage with the outside supports on this side.

To fold the folding scaffold for construction work according to the invention, the engaging segments of the wide scaffolding floor member are released from the connection to the supports and slightly lifted, and then the connecting frames on both sides are bent at the respective vertical shafts so that their central portions move inward and finally fold adjacent to each other between the two supports. Then, the scaffolding floor member is pivoted downwardly to a vertical position by rotation thereof about the horizontal shafts through which it is connected. In this manner, the scaffold can be stored with its height kept the same as before the folding and can be moved easily by using the wheels attached to the lower ends of the respective supports.

To extend the folding scaffold for construction work from the storage state to the usage state, the wide scaffolding floor member is pivoted to an upper horizontal position by rotation thereof about the horizontal shafts through which it is connected. In this state, the folded connecting frames on both sides are extended and the engaging segment attached to the wide scaffolding floor member is engaged with the respective supports. Thus, the scaffold is placed in a to usage state.

To change the height of the scaffold, the length of each supporting pipe having a double-pipe structure is adjusted after releasing the fixing means, and then the length of each supporting pipe thus adjusted is fixed by the fixing means. To ensure the safety of operations to be performed on the scaffold, the handrails are attached to the periphery of the top surface of the scaffolding floor member. The handrails are removed when the scaffold is folded.

Also where connecting frames and scaffolding floor members are provided on both sides of the central supporting members, the scaffold is placed in the storage state in a similar manner. That is, the scaffolding floor members on both sides are rotated about the horizontal shafts after the connecting frames on both sides of the central supporting members are folded. This type of scaffold is restored to the state of use in a similar manner. That is, the scaffolding floor members on both sides are lifted so as to become approximately horizontal, the connecting frames on both sides are extended, and finally the engaging segments of the respective scaffolding floor members are engaged with the top portions of the outside supports.

DETAILED DESCRIPTION OF THE PREFERRED EMBODIMENTS

Figure 1:
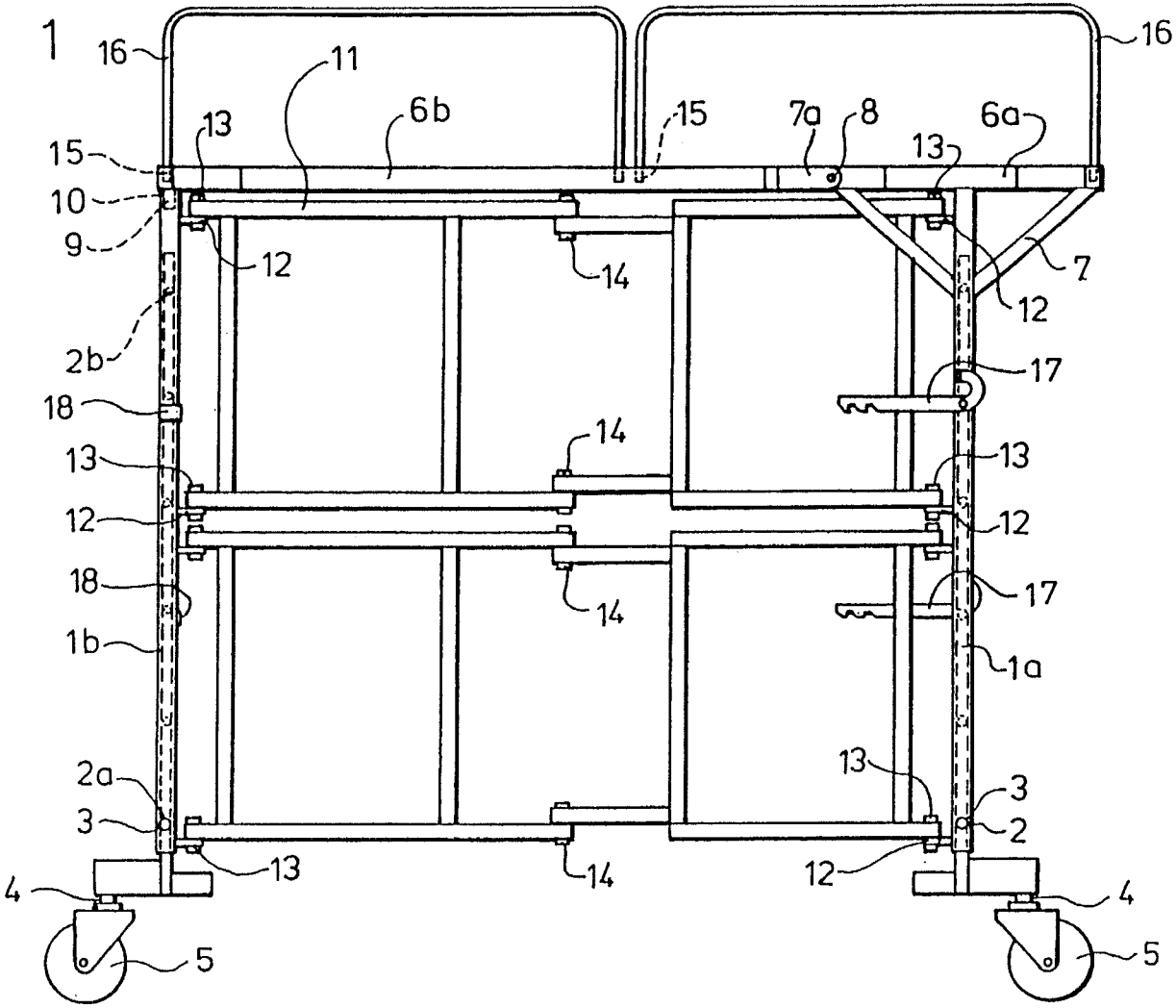
FIG. 1 is a side view of a scaffold for construction work according to a first embodiment of the present invention.
Figure 2:
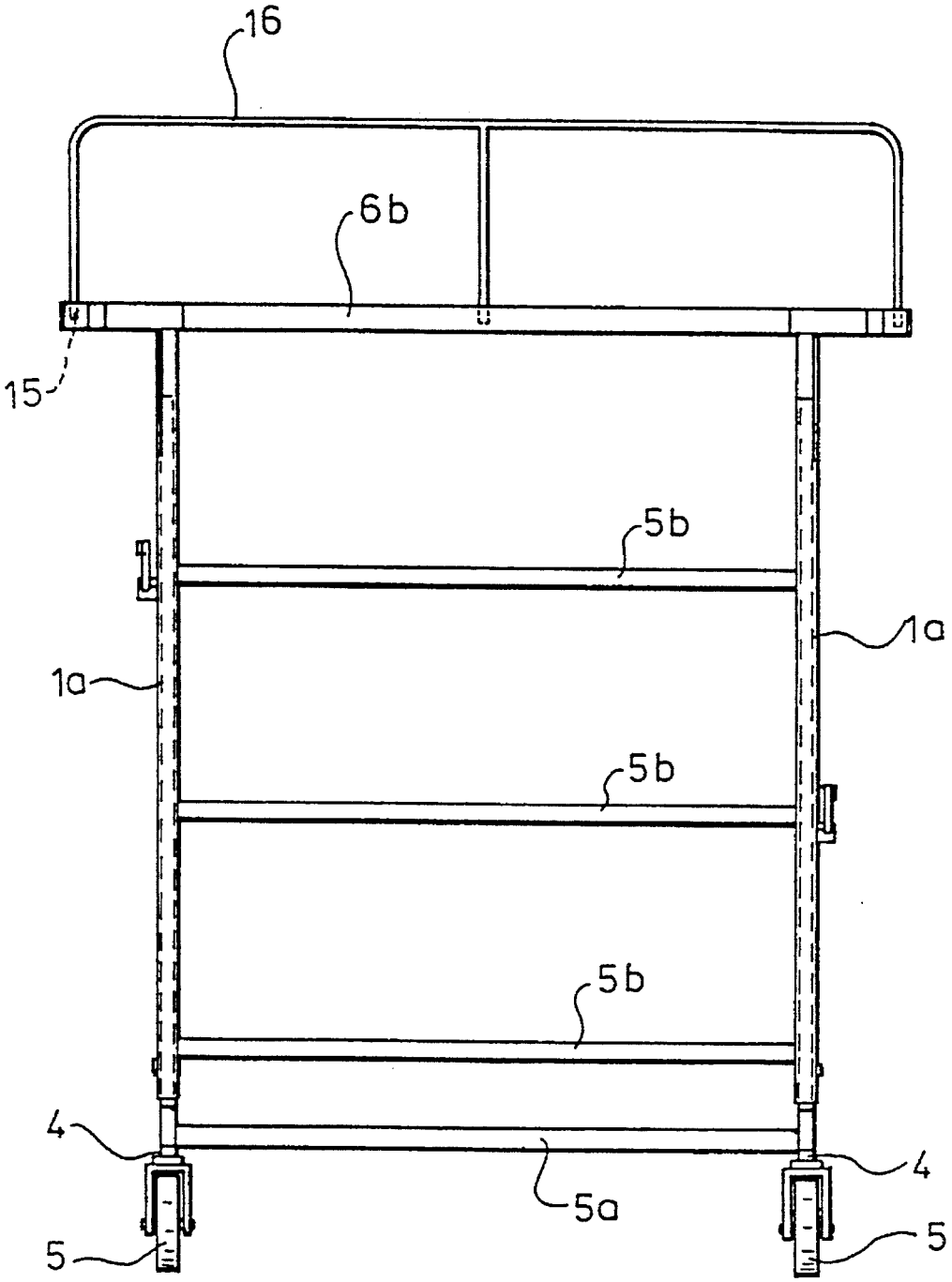
FIG. 2 is a front view of the scaffold for construction work according to the first embodiment of the invention.

A folding scaffold for construction work according to a first embodiment of the present invention will be described with reference to FIGS. 1–4.

Supports 1*a* and 1*b* are provided at positions corresponding to the four apices of a rectangle. Having a double-pipe structure, each supporting pipe 1*a* or 1*b* is capable of expansion and contraction. The outer pipe has a pin hole 2*a* at its bottom portion, and the inner pipe has pin holes 2*b* at proper intervals in the longitudinal direction. After the double pipes constituting the supports 1*a* and 1*b* are adjusted to an arbitrary length, the length can be fixed by a fixing means, which is constituted such that a pin 3 is inserted through the pin holes 2*a* and 2*b* of the outer and inner pipes fitted to each other. Furthermore, a wheel 5 is attached to the lower end of each supporting pipe 1*a* or 1*b* through a swivel shaft 4 so that the scaffold for construction work can be moved in any direction. Thus, the scaffold for construction work can be moved easily.

The two front supports 1*a* are connected to each other by a plurality of horizontal bars 5*b*, and the two rear supports 1*b* are connected to each other by a plurality of horizontal bars 5*b*. Those horizontal bars 5*b* serve as a ladder which an operator climbs in order to stand on the scaffolding floor members 6*a* and 6*b* (described later). While the outer pipes of the supports are connected to each other by the horizontal bars 5*b*, the lower end portions of the inner pipes are connected to each other by a horizontal bar 5*a*.

A narrow scaffolding floor member 6*a* is fixed on the two front supports 1*a*. Outside portions of the scaffolding floor member 6*a* and the front supports 1*a* are connected by stays 7 so as to increase the strength of the horizontal support of the narrow scaffolding floor member 6*a*. A top portion enclosed by the four supports 1*a* and 1*b*, except the portion of the narrow scaffolding floor member 6*a*, is covered with a wide scaffolding floor member 6*b*. Stays 7 are attached to the front end portions of the scaffolding floor member 6*b*, which are connected to the narrow scaffolding floor member 6*a* through horizontal shafts 8 so that the wide scaffolding floor member 6*b* can rotate about the shafts 8 so that its rear end portion can pivot downwardly. Each of the scaffolding floor members 6*a* and 6*b* is constructed by punching metals or steel plates mounted on a grid-like frame, so as to allow operators to stand thereon.

Peripheral portions of the scaffolding floor members 6*a* and 6*b* which correspond to a peripheral portion of the scaffold top surface have engagement holes 15 for insertion of handrails 16. To prevent the falling of workers from the scaffold, the lower ends of handrails 16 are inserted into the engagement holes 15 of the top surface of the scaffolding floor members 6*a* and 6*b* when the scaffold is used. The handrails 16 are removed from the engagement holes 15 when the scaffold is folded. Engagement segments 9 project from both side points of the rear end portion of the wide scaffolding floor member 6*b* and, the upper end portions of the two rear supports 1*b* have engagement holes 10 for receiving the engagement segments 9. When the scaffold is used, the engagement segments 9 are inserted into the engagement holes 10 and connecting frames 11 (described below) are held extended. When the scaffold is folded, the engagement segments 9 are removed from the engagement holes 10.

Figure 3:
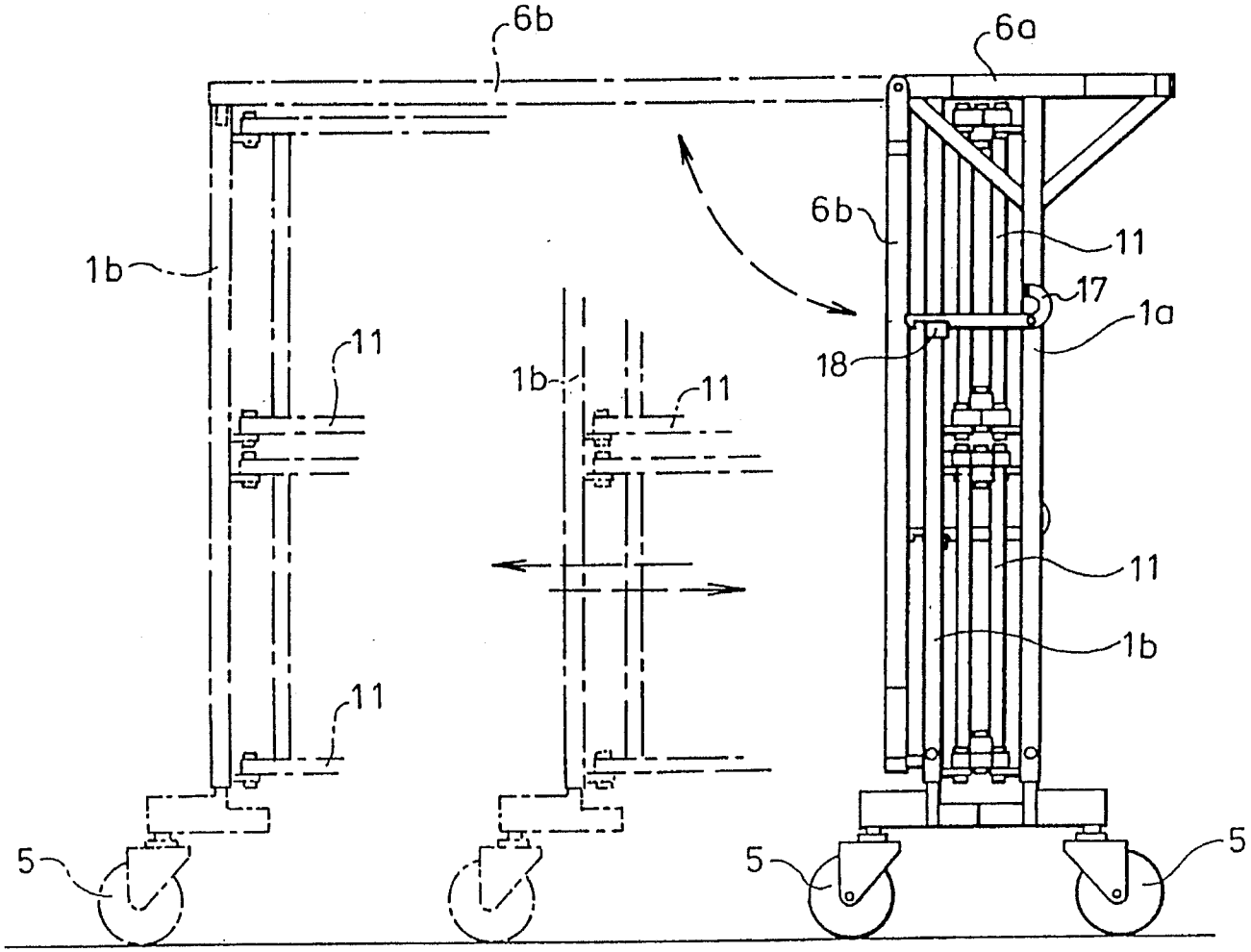
FIG. 3 is an explanatory side view showing a folded state of the scaffold for construction work according to the first embodiment of the invention.
Figure 4:
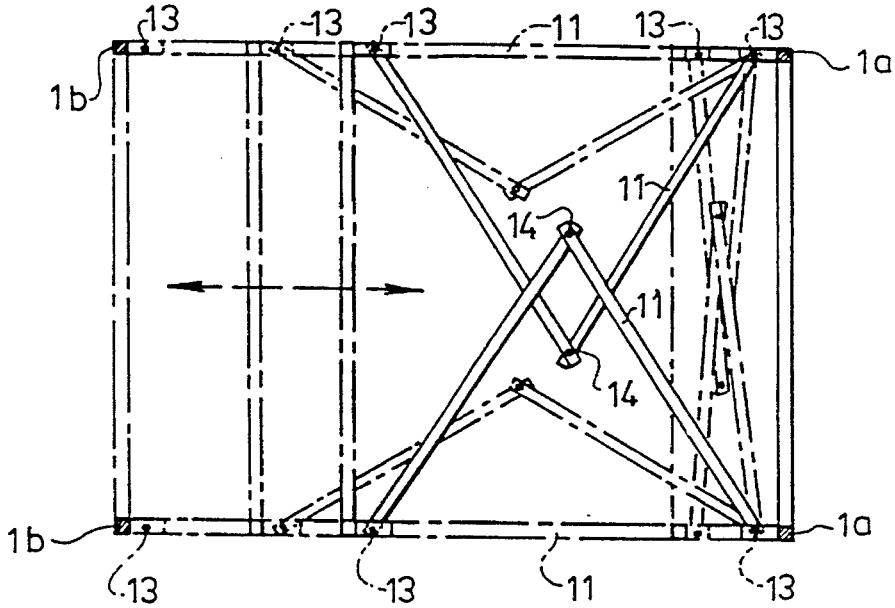
FIG. 4 is an explanatory top view showing the folded state of the scaffold according to the first embodiment of the invention.

The connecting frames 11 are provided between each pair of front and rear supports 1*a* and 1*b*. The connecting frames 11 have a height approximately half that of the supports, and the connecting frame 11 on one side is located in the upper half space of the scaffold and the connecting frame 11 on the other side is located in the lower half space so that they do not interfere with each other when the scaffold is folded in the manner described below. The upper and lower ends of the front and rear ends of each connecting frame 11 are rotatably connected, through vertical shafts 13, to brackets 12 attached to the respective supports 1*a* and 1*b*. Each connecting frame 11 is cut along the center line, and the resulting halves are rotatably connected to each other through vertical shafts 14 on the cutting line. As shown in FIG. 4, when the scaffold is folded, the connecting frame 11 is bent at the center, with its center portion moving inward, so as to assume an L shape. Finally, the connecting frames 11 are folded adjacent to each other between the two front supports 1*a*. After the connecting frames 11 are folded, the wide scaffolding floor member 6*b* is rotated about its connecting shafts 8 so that its rear end portion pivots downwardly. Thus, as shown in FIG. 3, the scaffold can be folded into the storage state without change in its height.

The front and rear supports 1*a* and 1*b* are provided with a binding metal fitting 17 and a binding receiving member 18, respectively. By engaging the binding metal fitting 17 with the binding receiving member 18 after the scaffold is folded and placed in to the storage state (see FIG. 3), the folded scaffold is prevented from coming unfolded. The scaffold can be extended to the usage state by releasing the above engagement. Furthermore, to prevent each connecting frame 11 from projecting outward when it is folded, stoppers (not shown) are provided in the vicinity of the shaft-connecting portions of the front and read ends of each connecting frame 11.

While, in this embodiment, the narrow scaffolding floor member 6*a* and the wide scaffolding floor member 6*b* are provided on the top surface, the wide scaffolding floor member 6*b* may be used without the narrow scaffolding floor member 6*a*. In this case, in the same manner as in the above embodiment, connecting members are attached to the top portions of the supports located at the front or rear end of the single scaffolding floor member 6*b* and the scaffolding floor member 6*b* is rotatably connected to the connecting members through horizontal shafts 8.

Figure 5:
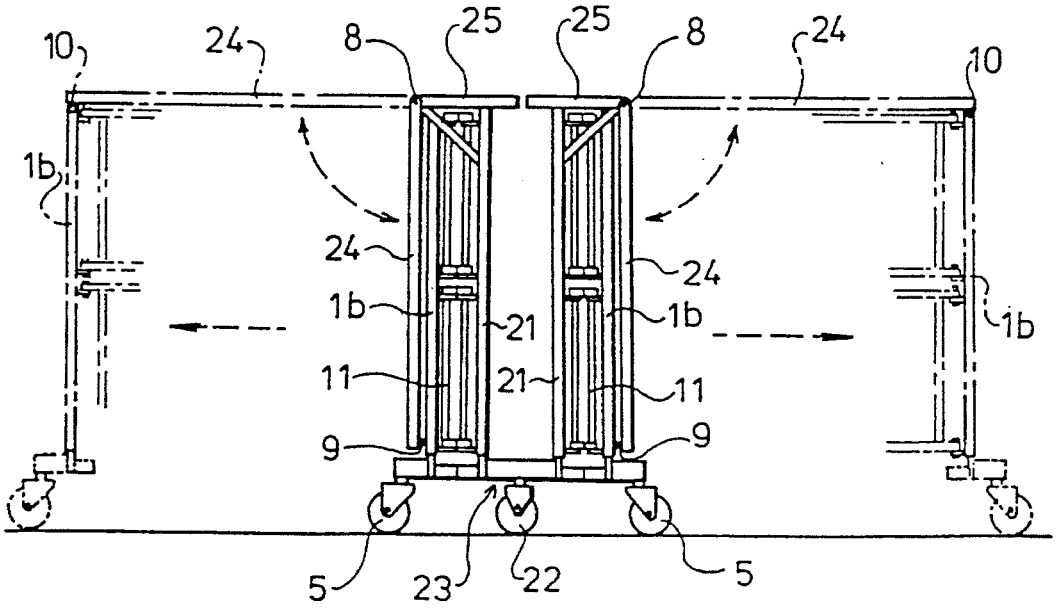
FIG. 5 is a side view of a scaffold for construction work according to a second embodiment of the invention.

A folding scaffold for construction work according to a second embodiment will be described with reference to FIG. 5. In the second embodiment, two of the scaffolds according to the first embodiment are connected such that a total of four supports located at the center portion are combined to produce two central supporting members.

Two supports 21 are connected to each other and a wheel 22 is attached to the bottom portion of the connected structure, to constitute a central supporting member 23. The two central supporting members 23 thus formed are disposed with a certain interval in between. Connecting frames 11, each constituted such that the halves are shaft-connected to each other in a foldable manner, are provided on both sides of each central supporting member 23. Having the same configuration as in the first embodiment, the connecting frame 11 can be bent as shown in FIG. 4 and folded adjacent to each other between the central supporting members 23. An outside supporting pipes **1*b* (which are the same as in the:first embodiment) having wheels 5 attached to their lower end is provided outside of each connecting frame 11**.

Scaffolding floor members 24 are located on each side of the central supporting members 23, and one end of each of is a respective one of connected to connecting members 25 through horizontal shafts 8 so that each scaffolding floor member 24 can be rotated about the shafts 8 so as to be set either horizontally or vertically. Furthermore,.as in the case of the first embodiment, engaging segments 9 are attached to the outside portion of each scaffolding floor member 24, and adapted to engage with the supports **1*b* located outside the connecting frames 11, more specifically, with engaging holes 10 in the top portions of the supports 1*b*. Thus, after the respective connecting frames 11 are folded adjacent to each other between the central supporting members 23, both scaffolding floor members 24 are rotated about the horizontal shafts 8 so that their outside ends are pivoted downwardly, thereby placing the scaffold in the storage state. Incidentally, the scaffolding floor member 24 may consist of two scaffolding floor members, i.e., wide and narrow scaffolding floor members 6*a* and 6*b* as in the case of the first embodiment, or of a single scaffolding floor member 6*b*. It is noted that the length of the supports 1*b* and supporting members 23** is adjustable as in the case of the first embodiment.

Figure 6:
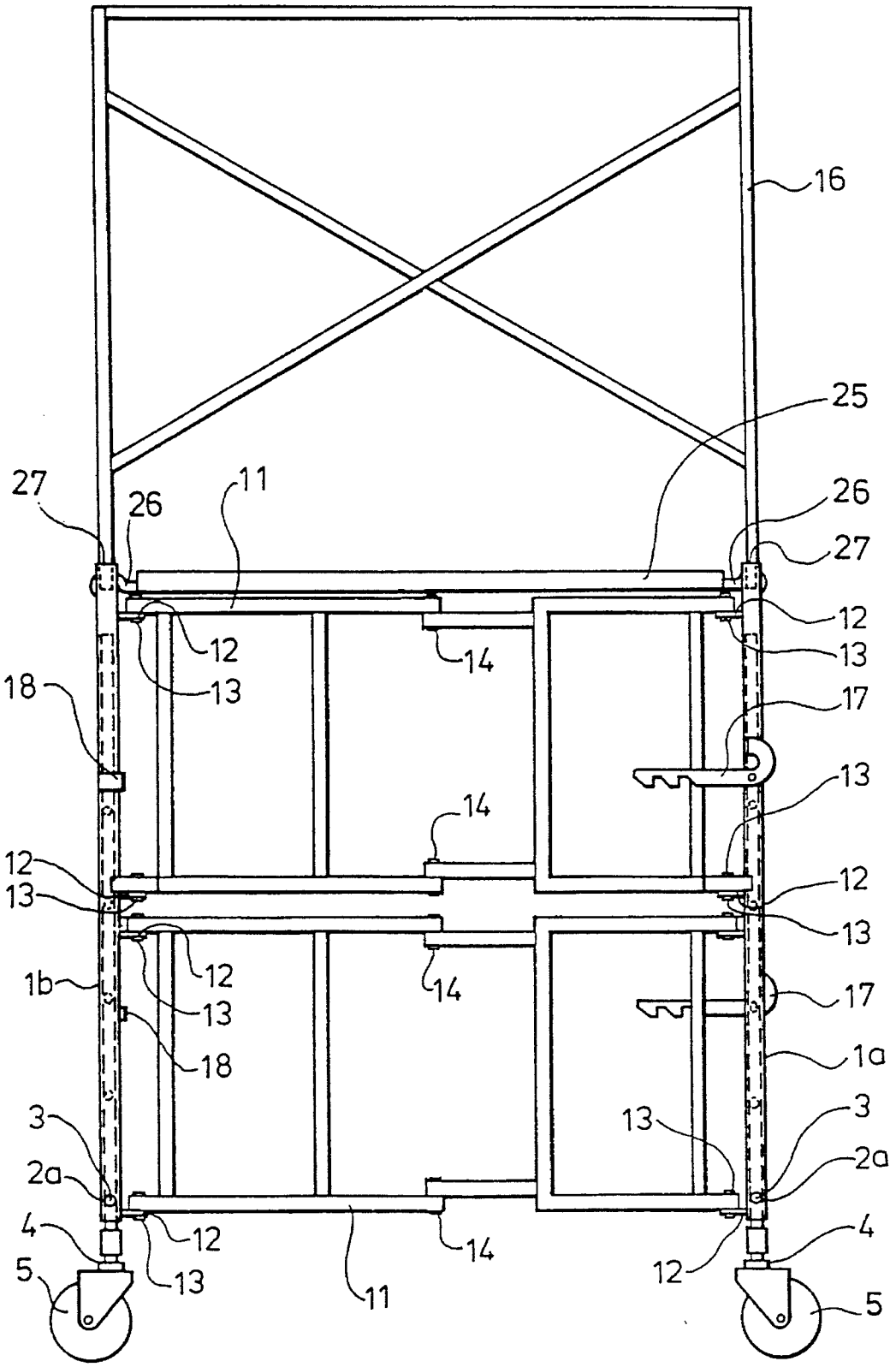
FIG. 6 is a side view of a scaffold for construction work according to a third embodiment of the invention.
Figure 7:
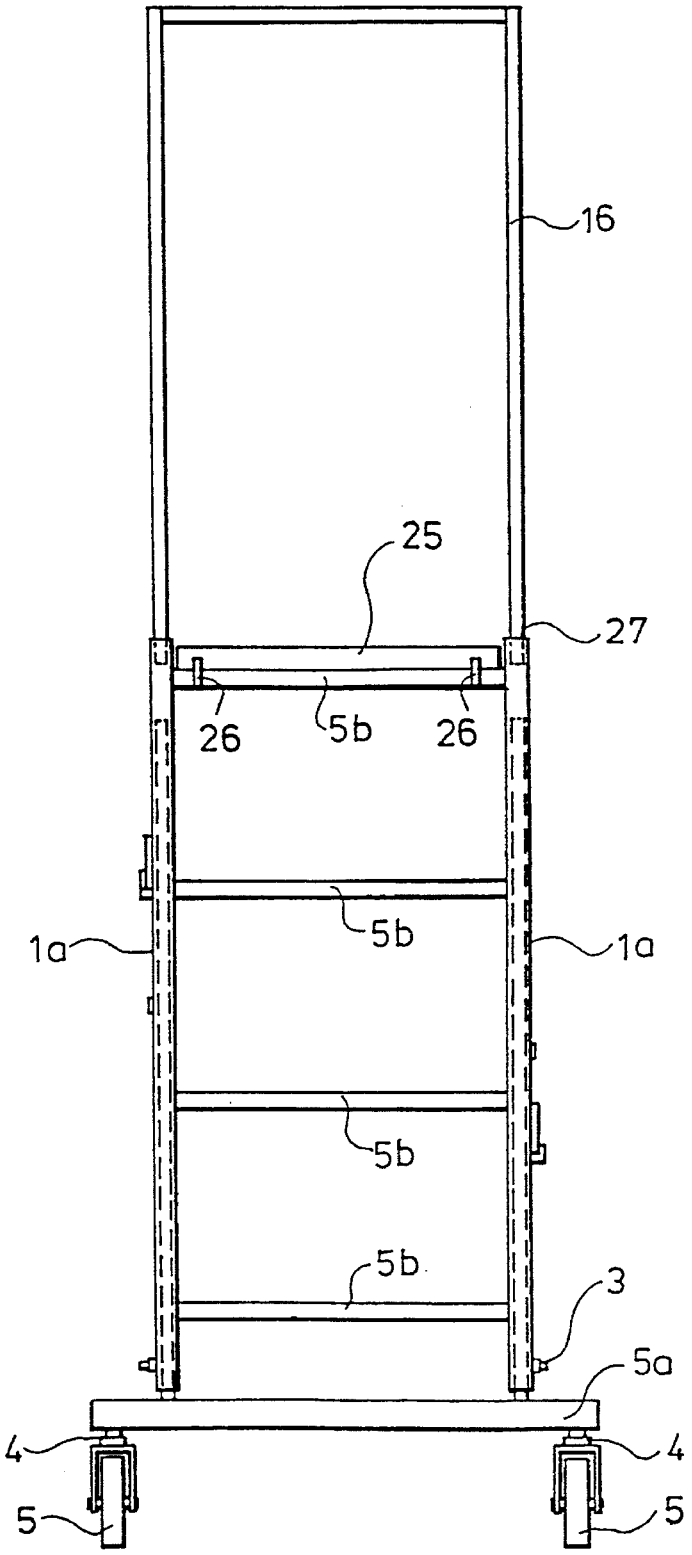
FIG. 7 is a front view of the scaffold for construction work according to the third embodiment of the invention.

A third embodiment of the invention will be described with reference to FIGS. 6 and 7.

In this embodiment, no scaffolding floor members are used to cover the top surface enclosed by the four supports **1*a* and 1*b* of the first embodiment located at the respective corners. Instead, a scaffolding plate 25 is put between a horizontal bar 5*b* attached to the upper ends of the two front supports 1*a* and a horizontal bar 5*b* attached to the upper ends of the two rear supports 1*b* so that a scaffolding floor for workers can be formed thereon. Hooks 26 are attached to the front and rear ends of the scaffolding plate 25, and hooked on the top horizontal bars 5*b*. Further, engagement holes 27 are provided at the respective upper end portions of the four supports 1*a* and 1*b* so that the lower ends of handrails 16 can be inserted into those holes 27**. The remaining construction and operation of the second embodiment are the same as in the first embodiment. It is possible to connect the two scaffolds for construction work according to the third embodiment in the manner of the second embodiment.

As described above, according to the invention, the scaffold for use in a constructing operation is constituted such that when it is folded, the connecting frames are folded adjacent to each other between the two front supports without any change in their height and the wide scaffolding floor member is rotated about its horizontal connection shafts so as to lower its end portion. As a result, the height of the scaffold can be kept low in its storage state and the scaffold can be moved easily. Furthermore, when the scaffold thus folded is extended into the state of use, the following simple operation is performed: The wide scaffolding floor member is rotated about its connection shafts so as to be set horizontally, then the connecting frames are unfolded, and finally the engaging segments are inserted into the engagement holes of the upper portions of the supports. Thus, the operation of extending the folded scaffold can be performed easily. Furthermore, also where no scaffolding floor member is used and the scaffolding plate is put between the front and rear horizontal bars, the scaffold can be folded easily from the state of use without a change of its height in the manner similar to the above. The folded scaffold can be extended.

Since the length of the supports is adjustable, the scaffold can accommodate different heights of construction work. Handrails can be attached to the top of the scaffold to ensure work safety. Furthermore, where scaffolding floor members and connecting frames are provided on both sides of the central supporting members, a scaffold having a wide floor area can be constituted in a foldable manner.

I claim:

1. A foldable construction scaffold comprising:

a first end support comprising first and second horizontally spaced apart vertically elongated unitary support members, and a plurality of first horizontal support bars connecting between said first and second support members;

a second end support comprising third and fourth horizontally spaced apart vertically elongated unitary support members, and a plurality of second horizontal support bars connecting between said third and fourth support members, each of said first, second, third and fourth unitary support members being of substantially the same height and positioned at substantially the same height;

a collapsible upper connecting frame comprising a first upper frame half having a base end pivotally mounted to said first support member for pivotal movement about a vertical axis, and a second upper frame half having a base end pivotally mounted to said third support member for pivotal movement about a vertical axis, free ends of said first upper frame half and said second upper frame half being pivotally connected to one another for pivotal movement of said first and second upper frame halves relative to one another about a vertical axis;

a collapsible lower connecting frame comprising a first lower frame half having a base end pivotally mounted to said second support member for pivotal movement about a vertical axis, and a second lower frame half having a base end pivotally mounted to said fourth support member for pivotal movement about a vertical axis, free ends of said first lower frame half and said second lower frame half being pivotally connected to one another for pivotal movement of said first and second lower frame halves relative to one another about a vertical axis;

a first scaffolding floor member having a first end pivotally mounted to a top end of said first end support for pivotal movement of said first scaffolding floor member, about a horizontal axis parallel with said first horizontal support bars, between a horizontal position spanning between said first and second end supports and a vertical position;

wherein a second end of said first scaffolding floor member has engagement segments engageable with a top end of said second end support;

wherein said collapsible upper connecting frame is disposed at a position above said collapsible lower connecting frame so as to be free from interference with said collapsible lower connecting frame upon collapsing of said collapsible upper and lower connecting frames, to allow both of said upper and lower connecting frames, when collapsed, to be disposed between said first and second end supports;

wherein said first and second end supports and said collapsible upper and lower connecting frames are constructed so that, when said collapsible upper and lower connecting frames are fully collapsed, said first and second end supports and said collapsible upper and lower connecting frames occupy a predetermined horizontal distance along a direction perpendicular to said first and second horizontal support bars; and wherein said horizontal axis about which said first scaffolding floor member is pivotally mounted to said first end support is spaced horizontally away from said top end of said first end support, in the direction perpendicular to said first and second horizontal support bars, by a distance approximately equal to said predetermined horizontal distance, so that said second end support and said collapsible upper and lower connecting frames are sandwiched between said first end support and said first scaffolding floor member when said first scaffolding floor member is in said vertical position and said collapsible upper and lower connecting frames are collapsed.

2. A foldable construction scaffold as recited in claim 1, further comprising a horizontal second scaffolding floor member fixed to said top end of said first end support, said first scaffolding floor member being pivotally mounted to said top end of said first end support through said second scaffolding floor member.

3. A foldable construction scaffold comprising:

a first end support comprising first and second horizontally spaced apart vertically elongated unitary support members, and a plurality of first horizontal support bars connecting between said first and second support members;

a second end support comprising third and fourth horizontally spaced apart vertically elongated unitary support members, and a plurality of second horizontal support bars connecting between said third and fourth support members, each of said first, second, third and fourth unitary support members being of substantially the same height and positioned at substantially the same height;

a collapsible upper connecting frame comprising a first upper frame half having a base end pivotally mounted to said first support member for pivotal movement about a vertical axis, and a second upper frame half having a base end pivotally mounted to said third support member for pivotal movement about a vertical axis, free ends of said first upper frame half and said second upper frame half being pivotally connected to one another for pivotal movement of said first and second upper frame halves relative to one another about a vertical axis;

a collapsible lower connecting frame comprising a first lower frame half having a base end pivotally mounted to said second support member for pivotal movement about a vertical axis, and a second lower frame half having a base end pivotally mounted to said fourth support member for pivotal movement about a vertical axis, free ends of said first lower frame half and said second lower frame half being pivotally connected to one another for pivotal movement of said first and second lower frame halves relative to one another about a vertical axis;

a horizontally-disposed narrow scaffolding floor member fixed to a top end of said first end support, being elongated in a width direction of said first end support so as to span between said first and second unitary support members, and having a predetermined dimension in a longitudinal direction from said first end support to said second end support;

a wide scaffolding floor member having first and second ends and a predetermined dimension in said longitudinal direction greater than the predetermined dimension of said narrow scaffolding floor member in said longitudinal direction, said first end of said wide scaffolding floor member being pivotally mounted to said narrow scaffolding floor member for pivotal movement of said wide scaffolding floor member relative to said narrow scaffolding floor member between a horizontal position in which said wide scaffolding floor member spans between said first and second end supports and a vertical position in which said wide scaffolding floor member depends downwardly from said narrow scaffolding floor member; and wherein said collapsible upper connecting frame is disposed at a position above said collapsible lower connecting frame so as to be free from interference with said collapsible lower connecting frame upon collapsing of said collapsible upper and lower connecting frames, to allow both of said upper and lower connecting frames, when collapsed, to be disposed between said first and second end supports.

4. A foldable construction scaffold as recited in claim 3, wherein said wide and narrow scaffolding floor members comprise planar members, respectively.

* * * * *